US010422068B2

(12) United States Patent
Ihne et al.

(10) Patent No.: US 10,422,068 B2
(45) Date of Patent: Sep. 24, 2019

(54) LAUNDRY TREATING APPLIANCE AND METHODS OF OPERATION

(71) Applicant: WHIRLPOOL CORPORATION, Benton Harbor, MI (US)

(72) Inventors: Sarah Ihne, Stevensville, MI (US); Karl David McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 295 days.

(21) Appl. No.: 15/042,565

(22) Filed: Feb. 12, 2016

(65) Prior Publication Data

US 2017/0233924 A1 Aug. 17, 2017

(51) Int. Cl.

| | |
|---|---|
| ***D06F 33/02*** | (2006.01) |
| ***D06F 37/30*** | (2006.01) |
| ***D06F 35/00*** | (2006.01) |
| ***D06F 37/02*** | (2006.01) |
| ***D06F 37/20*** | (2006.01) |
| ***D06F 39/00*** | (2006.01) |
| ***D06F 39/02*** | (2006.01) |
| ***D06F 39/08*** | (2006.01) |

(52) U.S. Cl.

CPC ..... *D06F 37/304* (2013.01); *D06F 33/02* (2013.01); *D06F 35/006* (2013.01); *D06F 37/02* (2013.01); *D06F 37/203* (2013.01); *D06F 39/003* (2013.01); *D06F 39/004* (2013.01); *D06F 39/028* (2013.01); *D06F 39/087* (2013.01); *D06F 2202/06* (2013.01); *D06F 2212/00* (2013.01)

(58) Field of Classification Search

CPC .... D06F 2232/04; D06F 35/006; D06F 33/02; D06F 2204/065

See application file for complete search history.

(56) References Cited

U.S. PATENT DOCUMENTS

| | | | | |
|---|---|---|---|---|
| 5,778,703 | A | 7/1998 | Imai et al. | |
| 2005/0034491 | A1* | 2/2005 | Tazawa ..... | D06F 33/02 68/12.03 |

(Continued)

FOREIGN PATENT DOCUMENTS

| | | | |
|---|---|---|---|
| EP | 0501240 | A1 | 9/1992 |
| EP | 1559826 | A2 | 8/2005 |

(Continued)

OTHER PUBLICATIONS

European Search Report for Counterpart EP17154039.6, dated Jul. 10, 2017.

*Primary Examiner* — Joseph L. Perrin
*Assistant Examiner* — Irina Graf
(74) *Attorney, Agent, or Firm* — McGarry Bair PC

(57) ABSTRACT

A laundry treating appliance includes a wash basket defining a treating chamber, having a clothes mover in the treating chamber to agitate the clothes during a cycle of operation for cleaning. A method of operating the laundry treating appliance can include supplying a wash liquid to the treating chamber and rotating the clothes mover within the treating chamber with an electric motor operating at a first duty cycle to define a high duty cycle wash phase and at a second duty cycle to define a low duty cycle wash phase after the first duty cycle.

21 Claims, 8 Drawing Sheets

(56) References Cited

U.S. PATENT DOCUMENTS

| | | | | |
|---|---|---|---|---|
| 2005/0257576 | A1* | 11/2005 | Omura | D06F 35/006 68/12.05 |
| 2009/0013480 | A1 | 1/2009 | Czyzewski et al. | |
| 2011/0016738 | A1* | 1/2011 | Ashrafzadeh | D06F 35/006 34/108 |
| 2011/0099732 | A1* | 5/2011 | Im | D06F 33/02 8/137 |
| 2012/0017380 | A1* | 1/2012 | Kim | D06F 35/006 8/137 |
| 2012/0266389 | A1* | 10/2012 | Ihne | D06F 39/02 8/137 |
| 2013/0091635 | A1* | 4/2013 | Guzman | D06F 35/005 8/137 |
| 2014/0033443 | A1 | 2/2014 | Flesch | |
| 2014/0189959 | A1* | 7/2014 | Dokonal | D06F 33/02 8/137 |
| 2015/0121630 | A1 | 5/2015 | Lee et al. | |

FOREIGN PATENT DOCUMENTS

| | | | | |
|---|---|---|---|---|
| EP | 1871941 | B1 | 7/2008 | |
| EP | 2471993 | A1 | 7/2012 | |
| EP | 2692936 | A1 | 2/2014 | |
| JP | 2011139771 | A | 7/2011 | |
| WO | WO-2014064269 | A1 * | 5/2014 | D06F 33/02 |

* cited by examiner

LAUNDRY TREATING APPLIANCE AND METHODS OF OPERATION

BACKGROUND

Laundry treating appliances, such as washing machines, refreshers, and non-aqueous systems, can have a configuration based on a rotating container that defines a treating chamber in which laundry items are placed for treating. In a vertical axis washing machine, the container is in the form of a perforated basket located within a tub; both the basket and tub typically have an upper opening at their respective upper ends. In a horizontal axis washing machine, the container is in the form of a perforated basket located within a tub; both the basket and tub typically have an opening at their respective front facing ends. The laundry treating appliance can have a controller that implements the cycles of operation having one or more operating parameters. The controller can control a motor to rotate the container according to one of the cycles of operation.

During cycles of operation, a duty cycle can be used to operate the motor at a rate to drive the basket or agitate the laundry. The duty cycle rates are typically run at a high or maximum duty cycle, expending energy in order to achieve a high cleaning performance over time, which tends to diminish machine efficiency.

BRIEF SUMMARY

In one aspect, a method of operating a horizontal axis clothes washer includes supplying wash liquid including a mixture of detergent and water to a wash basket defining a treating chamber and rotating a clothes mover within the treating chamber while the wash liquid is present with an electric motor operating at a first duty cycle greater than 75% for the horizontal axis clothes washer to define a high duty cycle wash phase. After the high duty cycle wash phase, the method further comprises rotating the clothes mover within the treating chamber while the wash liquid is present with the electric motor operating at a second duty cycle less than 50% for the horizontal axis clothes washer to define a low duty cycle wash phase. Parameters of the high duty cycle wash phase are determined, by a controller, based on at least one of a set of load characteristics or a set of operating characteristics.

In another aspect, a method of operating a horizontal axis clothes washer includes supplying wash liquid including a mixture of detergent and water to a wash basket defining a treating chamber and rotating a clothes mover within the treating chamber while the wash liquid is present with an electric motor operating at a first duty cycle equal to or greater than 75% for the horizontal axis clothes washer to define a high duty cycle wash phase. After the high duty cycle wash phase, the method further comprises rotating a clothes mover within the treating chamber while the wash liquid is present with the electric motor operating at a second duty cycle equal to or less than 50% for the horizontal axis clothes washer to define a low duty cycle wash phase. Further still, the method comprises delaying the start of the high duty cycle phase after supplying the wash liquid.

In another aspect, a method of operating a horizontal axis clothes washer comprises supplying wash liquid, to a wash basket defining a treating chamber, during a preliminary phase wherein the basket is not rotated or wherein the wash basket is rotated with an electric motor operating at a variable duty cycle, rotating the wash basket while the wash liquid is present, with an electric motor operating at a first duty cycle greater than 75% for the horizontal axis clothes washer to define a high duty cycle wash phase, and after the high duty cycle wash phase, rotating the wash basket while the wash liquid is present, with the electric motor operating at a second duty cycle less than 50% for the horizontal axis clothes washer to define a low duty cycle phase.

DETAILED DESCRIPTION

Figure 1:
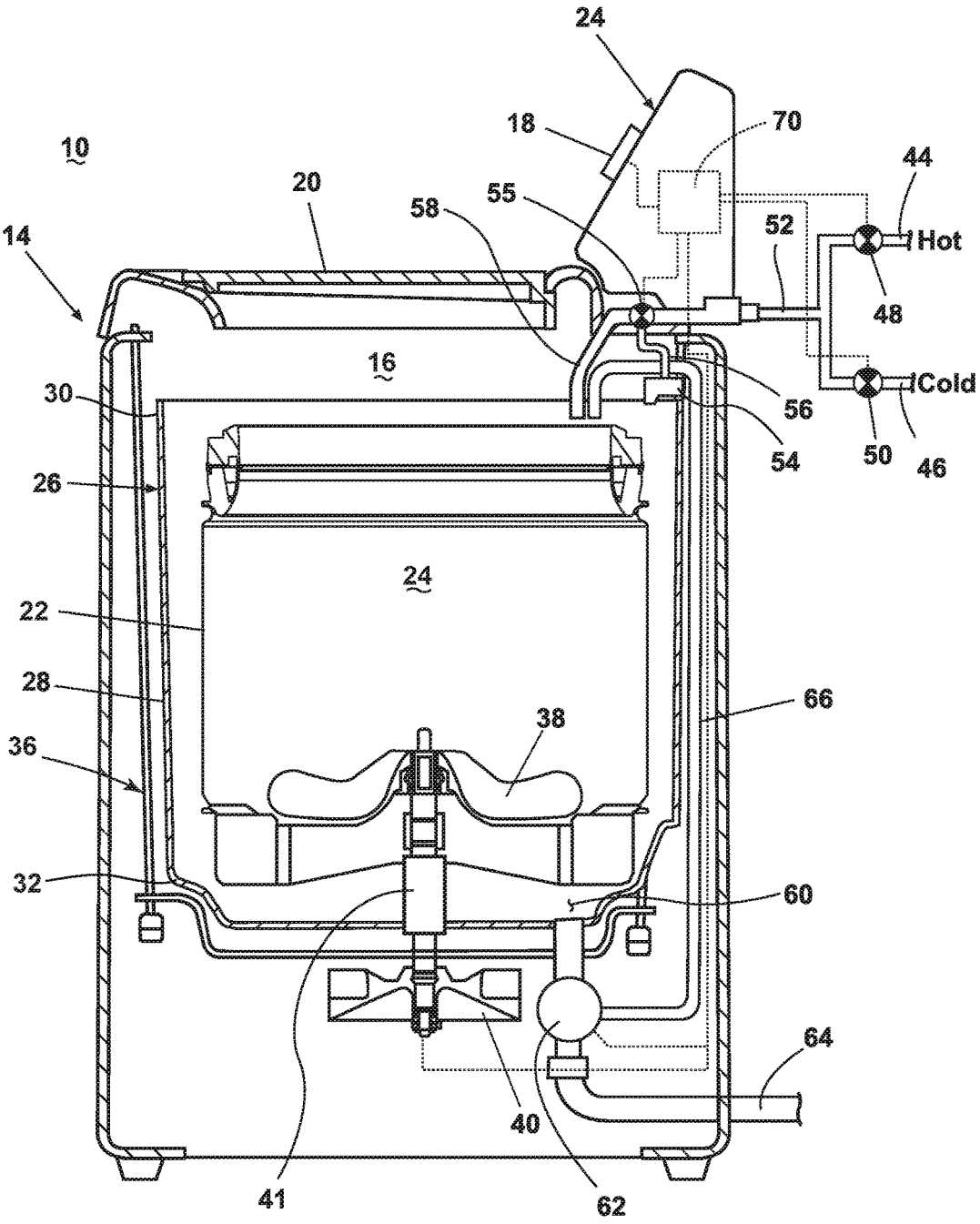
FIG. 1 is a schematic view of a laundry treating appliance in the form of a vertical washing machine.

FIG. 1 illustrates a laundry treating appliance in the form of a washing machine 10 according to an illustrative embodiment in accordance with the present disclosure. The laundry treating appliance is any machine that treats articles such as clothing or fabrics. Non-limiting examples of the laundry treating appliance can include a vertical washing machine; a horizontal washing machine, a combination washing machine and dryer; and a refreshing/revitalizing machine. The washing machine 10 described herein shares many features of a traditional automatic washing machine, which will not be described in detail except as necessary for a complete understanding of illustrative embodiments in accordance with the present disclosure.

As illustrated in FIG. 1, the washing machine 10 can include a housing 14 defining an interior 16. The housing 14 can be a cabinet or a frame to which decorative panels can or can not be mounted. A user interface 18 is included on the housing 14 and can have one or more knobs, switches, displays, and the like for communicating with the user, such as to receive input and provide output. A door or lid 20 is operably coupled with the housing 14 and is selectively moveable between opened and closed positions to close an opening in a top wall of the housing 14, which provides access to the interior 16 of the housing 14.

A rotatable basket 22 having an open top is disposed within the interior of the housing 14 and can define a treating chamber 24 for treating laundry. An imperforate tub 26 can also be positioned within the interior 16 of the housing 14 and can define an interior within which the rotatable basket 22 is positioned. The rotatable basket 22 can include a plurality of perforations (not shown), such that liquid can flow between the imperforate tub 26 and the rotatable basket 22 through the perforations. While the illustrated washing machine 10 includes both the imperforate tub 26 and the rotatable basket 22, with the rotatable basket 22 defining the treating chamber 24, it is within the scope of the present disclosure for the laundry treating appliance to include only one receptacle, with the receptacle defining the laundry treatment chamber for receiving the load to be treated and the tub.

The imperforate tub 26 is illustrated as including a peripheral wall 28 with an upper portion 30 and a bottom end 32. A suspension system 36 is provided within the interior 16 and mounts to the housing 14. The suspension system 36 dampens the vibrations generated during the rotational movement of the rotatable basket 22. The suspension system 36 can include a plurality of suspension rods, suitable springs, damping mechanisms, etc.

A clothes mover 38 is located in the rotatable basket 22 to impart mechanical agitation to a load of laundry placed in the rotatable basket 22. The rotatable basket 22 and the clothes mover 38 are driven by a drive system that includes a motor 40 operably coupled with the rotatable basket 22 and clothes mover 38. The motor 40 can be any suitable type of motor including an electrical motor. A clutch assembly 41 is included in the drive system and is provided to selectively operably couple the motor 40 with either the rotatable basket 22 and/or the clothes mover 38. The clothes mover 38 is oscillated or rotated about its axis of rotation during a cycle of operation in order to produce high water turbulence effective to wash the load contained within the treating chamber 24. The motor 40 can rotate or oscillate the rotatable basket 22 at various speeds in either rotational direction about an axis of rotation.

A liquid supply system is provided to supply liquid, such as water or a combination of water and one or more wash aids, such as detergent, into the treating chamber 24. The liquid supply system can include a water supply configured to supply hot or cold water. The water supply can include a hot water inlet 44 and a cold water inlet 46, a valve assembly, which can include a hot water valve 48, a cold water valve 50, and a diverter valve 55, and various conduits 52, 56. The valves 48, 50 are selectively openable to provide water, such as from a household water supply (not shown) to the conduit 52. The valves 48 and 50 can be opened individually or together to provide a mix of hot and cold water at a selected temperature. While the valves 48, 50 and conduit 52 are illustrated exteriorly of the housing 14, it is understood that these components can be internal to the housing 14.

As illustrated, a detergent dispenser 54 is fluidly coupled with the conduit 52 through a diverter valve 55 and a first water conduit 56. The detergent dispenser 54 can include means for supplying or mixing detergent to or with water from the first water conduit 56 and can supply such treating liquid to the imperforate tub 26. It has been contemplated that water from the first water conduit 56 can also be supplied to the imperforate tub 26 through the detergent dispenser 54 without the addition of a detergent. A second water conduit, illustrated as a separate water inlet 58, can also be fluidly coupled with the conduit 52 through the diverter valve 55 such that water is supplied directly to the treating chamber through the open top of the rotatable basket 22. Additionally, the liquid supply system can differ from the configuration shown, such as by inclusion of other valves, conduits, wash aid dispensers, heaters, sensors, such as liquid level sensors and temperature sensors, and the like, to control the flow of treating liquid through the washing machine 10 and for the introduction of more than one type of detergent/wash aid.

A liquid recirculation system is provided for recirculating liquid from the imperforate tub 26 into the treating chamber 24. More specifically, a sump 60 is located in the bottom of the imperforate tub 26 and the liquid recirculation system is configured to recirculate treating liquid from the sump 60 onto the top of a laundry load located in the treating chamber 24. A pump 62 is housed below the perforate or imperforate tub 26 and can have an inlet fluidly coupled with the sump 60 and an outlet configured to fluidly couple to either or both a household drain 64 or a recirculation conduit 66. In this configuration, the pump 62 is used to drain or recirculate wash liquid in the sump 60. As illustrated, the recirculation conduit 66 is fluidly coupled with the treating chamber 24 such that it supplies liquid into the open top of the rotatable basket 22. The liquid recirculation system can include other types of recirculation systems.

Figure 2:
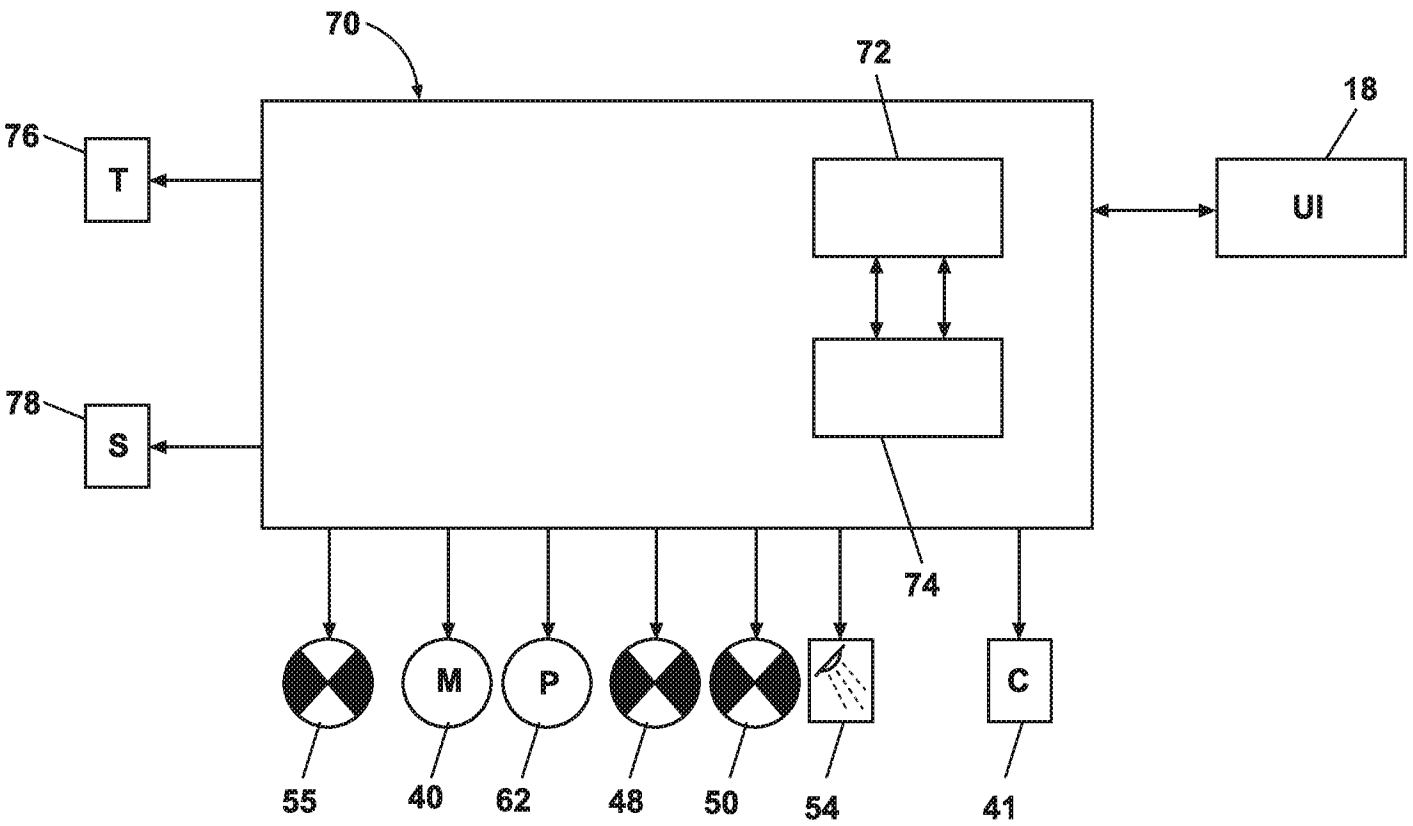
FIG. 2 is a schematic of a control system for the laundry treating appliance of FIG. 1.

The washing machine 10 can further include a controller 70 coupled with various working components of the washing machine 10 to control the operation of the working components. As illustrated in FIG. 2, the controller 70 is provided with a memory 72 and a central processing unit (CPU) 74. The memory 72 is used for storing the control software that is executed by the CPU 74 in completing a cycle of operation using the washing machine 10 and any additional software. The memory 72 can also be used to store information, such as a database or table, and to store data received from the one or more components of the washing machine 10 that is communicably coupled with the controller 70.

The controller 70 is operably coupled with one or more components of the washing machine 10 for communicating with and/or controlling the operation of the components to complete a cycle of operation. For example, the controller 70 is coupled with the hot water valve 48, the cold water valve 50, diverter valve 55, and the detergent dispenser 54 for controlling the temperature and flow rate of treating liquid into the treating chamber 24; the pump 62 for controlling the amount of treating liquid in the treating chamber 24 or sump 60; the motor 40 and clutch assembly 41 for controlling the direction and speed of rotation of the rotatable basket 22 and/or the clothes mover 38; and the user interface 18 for receiving user selected inputs and communicating information to the user. The controller 70 can also receive input from a temperature sensor 76, such as a thermistor, which can detect the temperature of the treating liquid in the treating chamber 24 and/or the temperature of the treating liquid being supplied to the treating chamber 24. The controller 70 can also receive input from various additional sensors 78, which are known in the art and not shown for simplicity. Non-limiting examples of additional sensors 78 that is communicably coupled with the controller 70 include: a weight sensor, and a motor torque sensor.

The washing machine 10 can perform one or more manual or automatic treating cycles or cycle of operation. A common cycle of operation includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases.

During a cycle of operation, including within the wash phase, a duty cycle relates to the amount of motor operation. The term duty cycle as used herein relates to the amount of time rotating and or agitating the fabric in the washing machine 10 over a specified period or number or rotations per stroke or per time. Thus, the duty cycle for a horizontal washing machine is defined as the amount of time rotating/agitating in a specific period or a percentage of 'on' time to 'total' time. For example, an 81% duty cycle is 13 seconds of 'on' motor operation and a 3-second pause, or 'off' motor operation, for a total time of 16 seconds, having 13 divided by 16 as 0.81. The term "high duty cycle" as used herein is a duty cycle that is equal to or greater than 75% motor operation time during a specified period. The term "low duty cycle" as used herein is a duty cycle that is equal to or less than 50% motor operation time during a specified period.

For a vertical axis washing machine, duty cycle is defined as the number of rotations per stroke or the number of rotations per second. To calculate these values the integration of one stroke must be calculated. One stroke is defined as a motor ramp from zero to a steady-state rotation per minute (rpm) value for a specified amount of time, then maintains that steady-state value for a specified amount of time and then ramps down to zero rpm for a specified amount of time. To complete the stroke, a pause time can be included after the motor ramps down to zero where no motor action is occurring. The number of rotations per stroke can be determined by integrating an area under a curve of ramp time to pause time. The number of rotations per time can be determined by integrating the area under the curve and dividing this value by the total time of the stroke specified. For example, if the motor took 0.3 seconds to ramp to 150 rpm then stayed at 150 rpm for 0.3 seconds and then 0.3 seconds to ramp down to zero with no pauses, the number of rotations per stroke and the number of rotations per second is 1.5 and 1.67 respectively. If there included a 0.1 second pause after the motor ramp down, then the number of rations per stroke and the number of rotations per second would be 1.35 and 1.35 respectively. Thus, the term "high duty cycle" as used herein that is equal to or greater than the number of rotations per stroke and the number of rotations per second of 0.50 and 1.00, respectively. The term "low duty cycle" is used herein that is less than then number of rotations per stroke and the number or rotations per second of 1.75 and 1.75, respectively.

Figure 3:
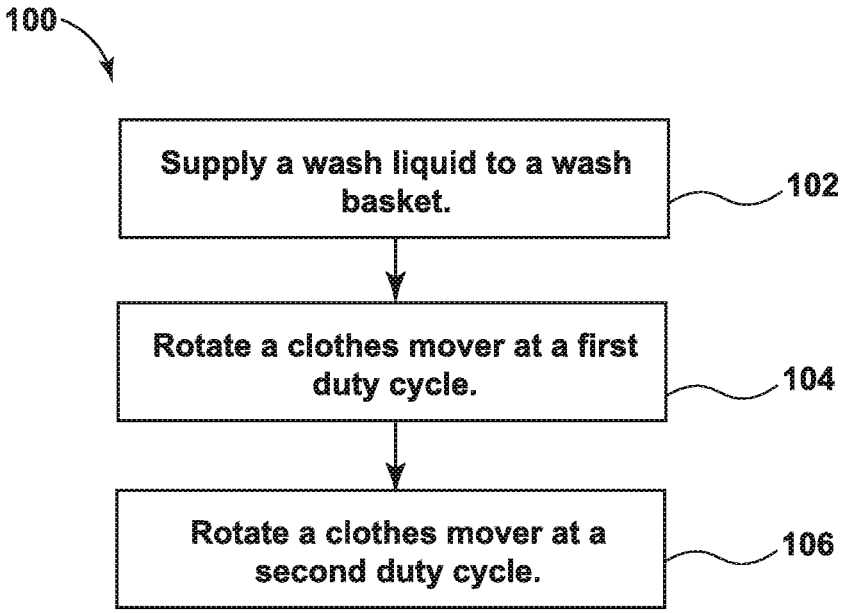
FIG. 3 is a flow chart illustrating a method of operating the laundry treating appliance of FIG. 1.

Referring now to FIG. 3, a flow chart of a method 100 for controlling the operation of the washing machine 10 is illustrated. The sequence of steps depicted for this method is for illustrative purposes only, and is not meant to limit the method, as it is understood that the additional or intervening steps may be included without detracting from the present disclosure. The method 100 starts with assuming that the user has placed one or more laundry items for treatment within the treating chamber 24 and selected a cycle of operation through the user interface 18.

The method 100 may be implemented during any suitable portion of a cycle of operation, including a wash phase, or may be implemented as a separate cycle of operation.

At 102, wash liquid, comprising a mixture of detergent and water, can be supplied to a wash basket 22 defining the treating chamber 24. At 104, the clothes mover 38 can be rotated within the treating chamber 24 while the wash liquid is present. More specifically, the clothes mover 38 can be rotated via the motor 40 operating at a first duty cycle equal to or greater than 75% to define a high duty cycle wash phase. After the high duty cycle wash phase at 104, the clothes mover can be rotated within the treating chamber 24, at 106. At 106, the rotating of the clothes mover 38 is while the wash liquid is present and with the electric motor 40 operating at a second duty cycle equal to or less than 50% to define a low duty cycle wash phase. While the clothes mover 38 has been described as being rotated it will be understood that this can include both full rotations of the clothes mover 38 and oscillation of the clothes mover 38 and the high and low duty cycle for the vertical axis washing machine. Further still, while the method describes rotating the clothes mover 38 it will be understood that in the alternative the wash basket 22 can be rotated by the motor 40 with the motor 40 being operated at a high duty cycle and then at a low duty cycle to achieve similar results. This may be especially true in a horizontal axis washing machine.

Figure 4:
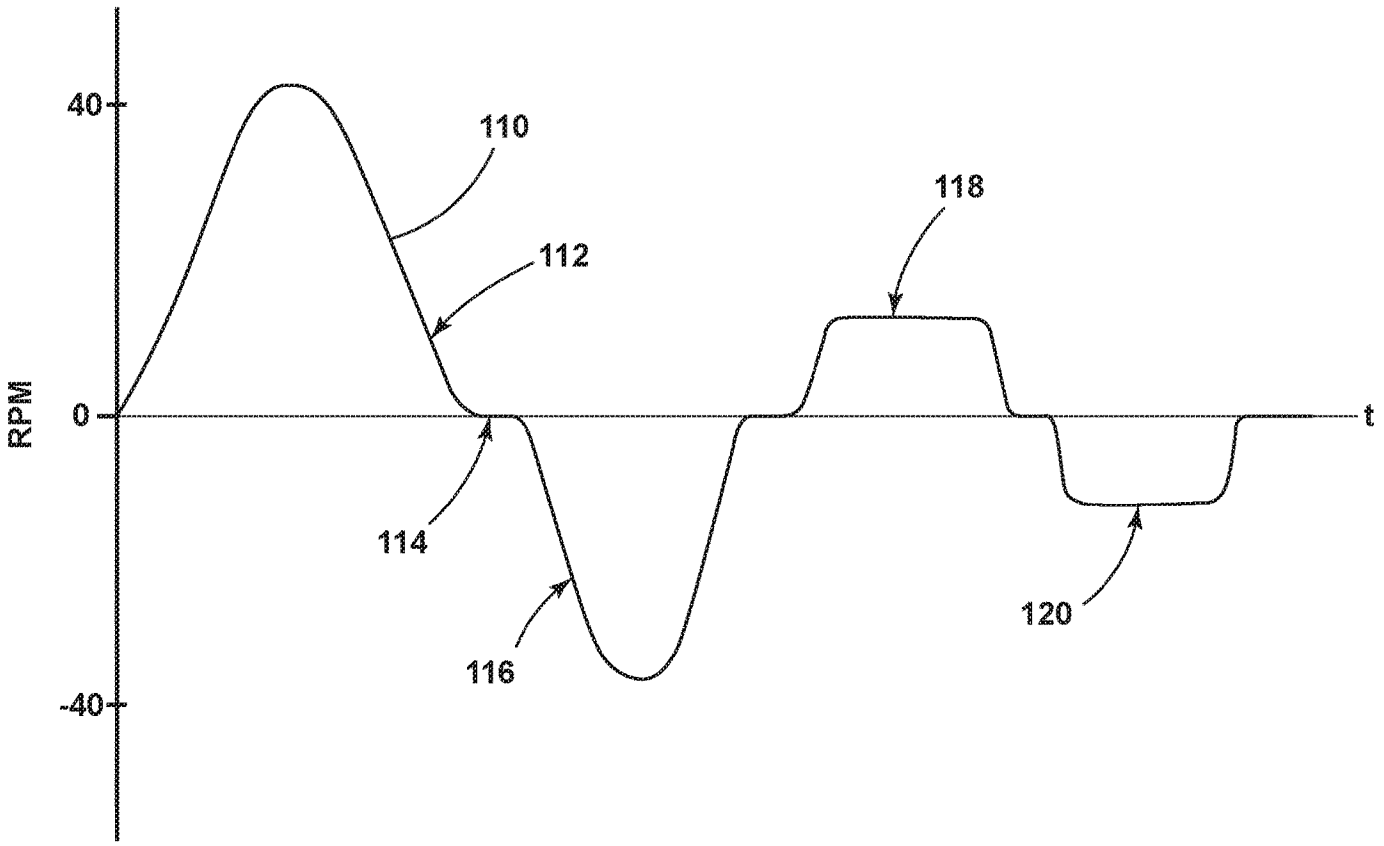
FIG. 4 is a plot illustrating rotational speeds and directions for the laundry treating appliance during a cycle of operation.

Turning to FIG. 4, a plot 110 illustrates rpm over time for the wash basket 22 for the washing machine 10. As can be appreciated, to rotation of the wash basket 22 can initially increase up to about 40 rpm in a first direction 112. After reaching 40 rpm, the speed can gradually decrease until rotation stops at a rest period 114. Rotation can begin in the opposite direction 116 until about −40 rpm is reached. The magnitude of the speed can again decrease, as returning to zero, until reaching a second rest period 114. The rotation can being again in the same direction as the first direction 112 until reaching about 20 rpm. The rotational speed can be constant 118 in the first direction at about 15 rpm for a period of time and decrease until coming to rest period 114. Rotation can begin in the opposite direction and become constant 120 for a period of time at about −15 rpm. The rotational speed can decrease, returning to zero, and again come to rest. It should be appreciated that the values for rpm as illustrated in FIG. 4 are exemplary and that plot 110 shows exemplary rotational movement of the wash basket 22 over time during any wash cycle. It should be understood from FIG. 4 that during a cycle of operation, such as a high duty cycle, the rotational speed of the wash basket 22 can be increasing, decreasing, constant, or at rest. Rates of increase or decrease can be constant or variable, having a plot 110 being linear or non-linear, respectively. Additionally this rotation can move in a first direction, being represented as a positive direction, or in an opposite direction, being represented as a negative direction.

Figure 5A:
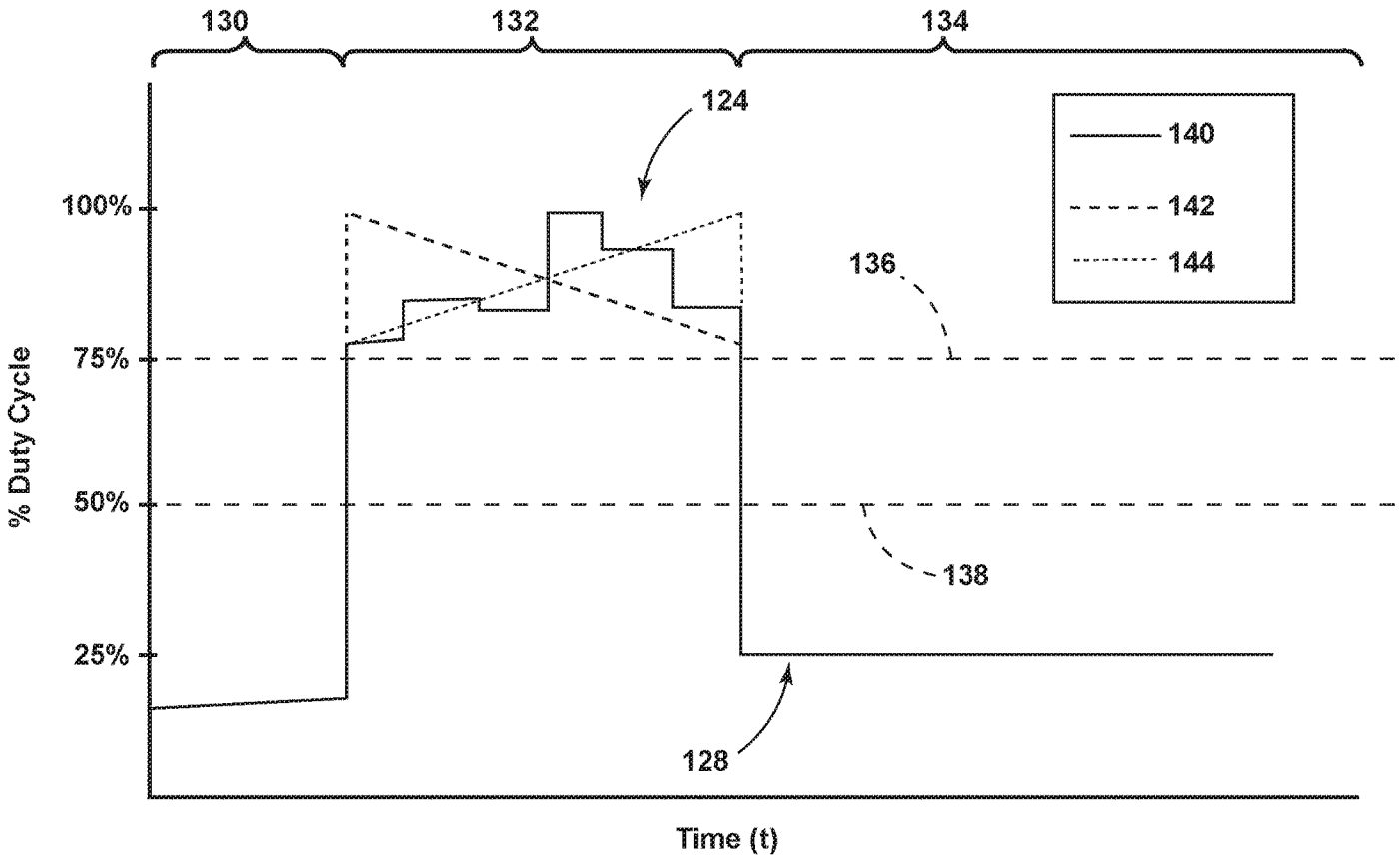
FIG. 5A is a plot illustrating three exemplary duty cycles for multiple phases during the cycle of operation of FIG. 4.
Figure 5B:
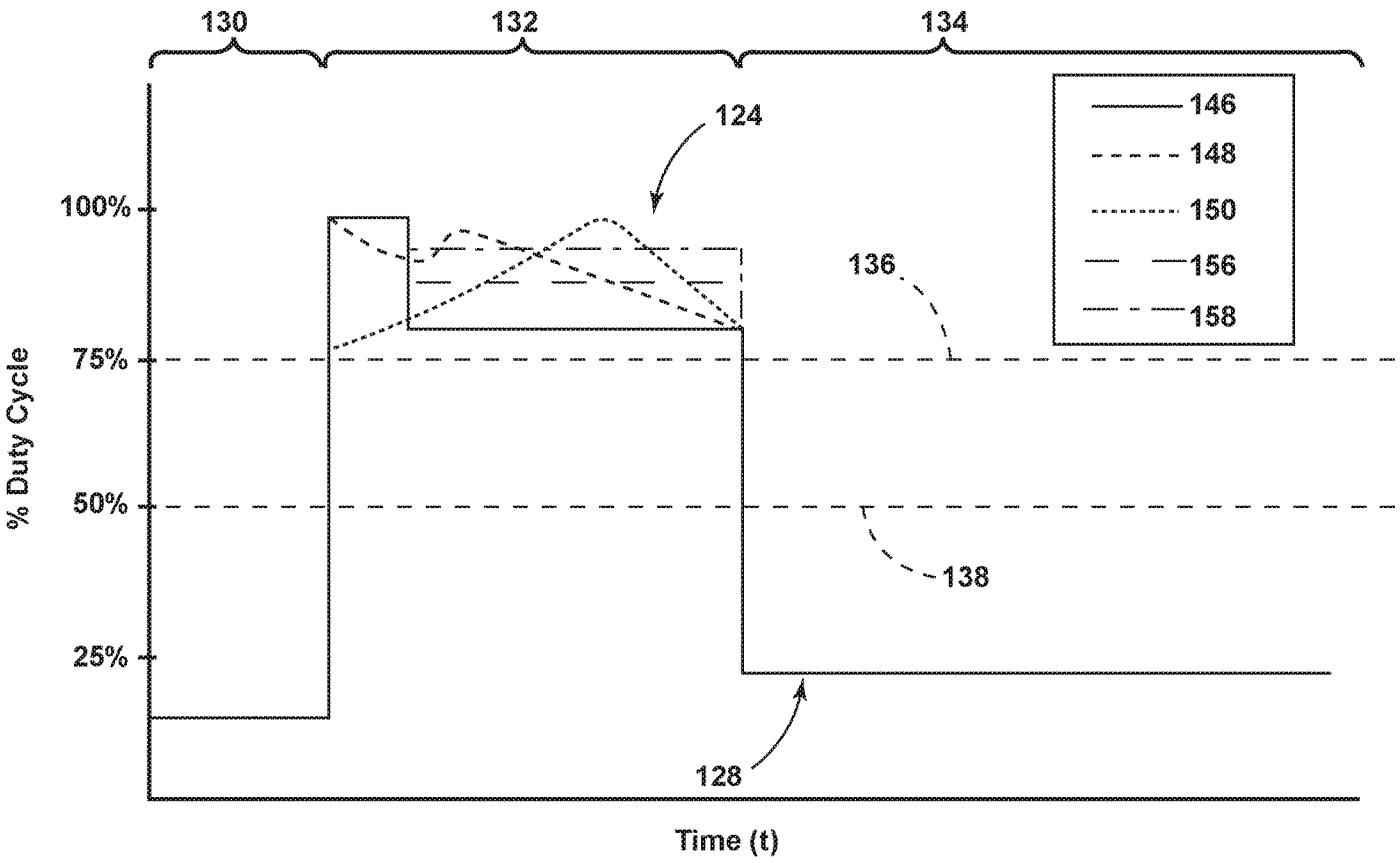
FIG. 5B is another plot illustrating three additional exemplary duty cycles for multiple phases during the cycle of operation of FIG. 4.

Turning now to FIGS. 5A and 5B, a cycle of operation for the washing machine 10 can be separated into a first duty cycle 124 and a second duty cycle 128. The first duty cycle 124 can include a high duty cycle phase 132 and the low duty cycle 128 can include a low duty cycle phase 134. The high duty cycle phase 132 can be defined as operation of the motor 40 at greater than 75% duty cycle 136 and the low duty cycle phase 134 can be defined as operation of the motor 40 at less than 50% duty cycle 138 for a horizontal axis washing machine. Alternatively, for a vertical axis washing machine, a high duty cycle can be greater than 0.50 rotations per stroke or greater than 1.00 rotations per second and a low duty cycle can be less than 1.75 rotations per stroke or 1.75 rotations per second.

The cycle of operation can include a preliminary phase 130 before the first and second duty cycles 124, 128. The duty cycle during the preliminary phase 130 can be relatively low at about 15%. Alternatively, the duty cycle during the preliminary phase 130 can be zero, increasing, decreasing, constant, or variable. The preliminary phase 130 can be useful in measuring one or more load characteristics or operating characteristics prior to the high duty cycle phase 132. It is contemplated that the preliminary phase 130 can be optional or can only be utilized when specifically told by a user, based on a specific cycle of operation or option, or when the controller 70 determines that it is beneficial. Additionally, the preliminary phase 120 can be utilized to make sensor measurements for determining quantities including, but not limited to, load mass or soil level, for example.

Similarly, if the consumer is using a pod or single dose detergent, the washing machine 10 can be paused a certain amount of time to allow for the pod or detergent dose to soak, after which the high duty cycle phase 132 can begin.

Furthermore, if the user intends to dispense any type of fabric treatment or fabric enhancer that provides for pre-treatments, the controller 70 can control the washing machine 10 to wait for a predetermined amount of time to allow for pretreatment before beginning the high duty cycle phase 132. Alternatively, the preliminary phase 130 might involve a low-duty cycle operation of the washing machine 10 to promote soaking or pretreatment based on, for example, different fabric types. Additionally, reverse oscillations at a low-duty cycle can promote uniform distribution of detergent or other treating chemistries.

It is further contemplated that there may not be a preliminary phase 130 at all. The decision on whether to have a preliminary phase 130 can depend on whether the controller 70 detects the existence of a condition that warrants the preliminary phase 130. For example, a user can make user interface selections reflecting that a pod will be used or that pretreatment of the laundry is desired. Alternatively, the washing machine 10 can have a sensing mechanism to detect the presence of a pod or pretreatment. Either of these scenarios can inform the washing machine 10 as to whether it should utilize a preliminary phase 130. It will also be understood that earlier mixing or more mixing of detergents within the wash liquid can result in faster initial cleaning rates.

After any optionally included preliminary phase 130, the first duty cycle 124 of the operation of the motor 40 to can begin as the high duty cycle phase 132. Looking at FIG. 5A, during the high duty cycle phase 132, the duty cycle can be constant, increasing, decreasing, or variable. For example, as shown by plot 140, the duty cycle can be constant for a portion of time, but can vary between differing constant rates in a stepped manner. Plot 142 illustrates a duty cycle that can begin at or near 100% and decrease at a constant rate during the high duty cycle phase 132, while remaining above 75% duty cycle. Plot 144 illustrates a duty cycle that can being just above 75% and increasing during the high duty cycle phase 132 at a constant rate. It should be appreciated that the decrease and increase illustrated by plots 142 and 144 can be linear or non-linear.

Looking at FIG. 5B, three additional exemplary plots are illustrated during the high duty cycle phase 132. Plot 146 illustrates a duty cycle that begins at or near 100% duty cycle for a period of time and decreases to a lower duty cycle for a second period of time. Plot 148 illustrates a duty cycle that begins at or near 100% and decreases initially, then briefly increases before decreasing further prior to entering the low duty cycle phase 134. Plot 150 illustrates a high duty cycle phase 132 that initially increases up to about 100% duty cycle then decreases before entering the low duty cycle phase 134.

It should be appreciated that the plots 140, 142, 144, 146, 148 and 150 are exemplary of duty cycles that can occur during the high duty cycle phase 132. It should be understood that the plots are non-limiting and are only illustrative of the potential for the duty cycle during the high duty cycle phase 132 to be constant, variable, increasing, decreasing, linear, non-linear, or any combination thereof. Additionally, the duty cycle during the high duty cycle phase 132 can be based upon a set of load characteristic or operating characteristics determined by the controller 70. For example, an increasing duty cycle during the high duty cycle phase 132 may be more beneficial for a load having a high load weight while a decreasing duty cycle during the high duty cycle phase 132 may be more beneficial for a load having a low load weight.

In one specific instance illustrated as plot 144 in FIG. 5A, the duty cycle initializes at about 75% duty cycle and then increases at a specific rate until reaching 100% duty cycle. An optimum duty cycle, based upon experimental analysis, can be represented by the following equation:

$$D=\tfrac{25}{30}t+75 \tag{1}$$

where D=duty cycle and t=time. t can be represented by minutes and can increase from 0 to 30, for example, based on a 30-minute cycle. As time increases, the duty cycle should also increase to have the optimal cleaning performance as a function of time. Therefore, the increasing slope for the first duty cycle 124 is representative of the increase in duty cycle over time to maintain optimal cleaning performance represented in equation (1). For example, the equation above relates to gradually increasing the duty cycle of the motor in the first 30 minutes of a cycle of operation. As time increases, the duty cycle also increases resulting in a better cleaning performance in the given amount of time.

Additionally, where the first duty cycle 124 can be constant, the duty cycle can be 90%, as shown in FIG. 5B at plot 156, or greater, as shown by plot 158. The rate of cleaning performance is greatest at the beginning of the wash cycle. Therefore, it is beneficial to increase the amount of energy applied during about the first 20 minutes of the cycle. To achieve the best cleaning performance, the duty cycle during this time can be between 90% and 100%.

After the high duty cycle phase 132, the second duty cycle 128 begins. The second duty cycle 128 includes a low duty cycle phase 134, operating the motor 40 having a duty cycle equal to or less than 50%. The low duty cycle phase 126 can be constant or can vary in time, and can comprise a second duty cycle 128 as low as 25% or lower.

The high duty cycle phase 132 can extend for a first predetermined time and the low duty cycle phase 134 can extend for a second predetermined time. The first predetermined time can be less than twenty minutes. It is contemplated that the second predetermined time can be longer than the first predetermined time.

Figure 6:
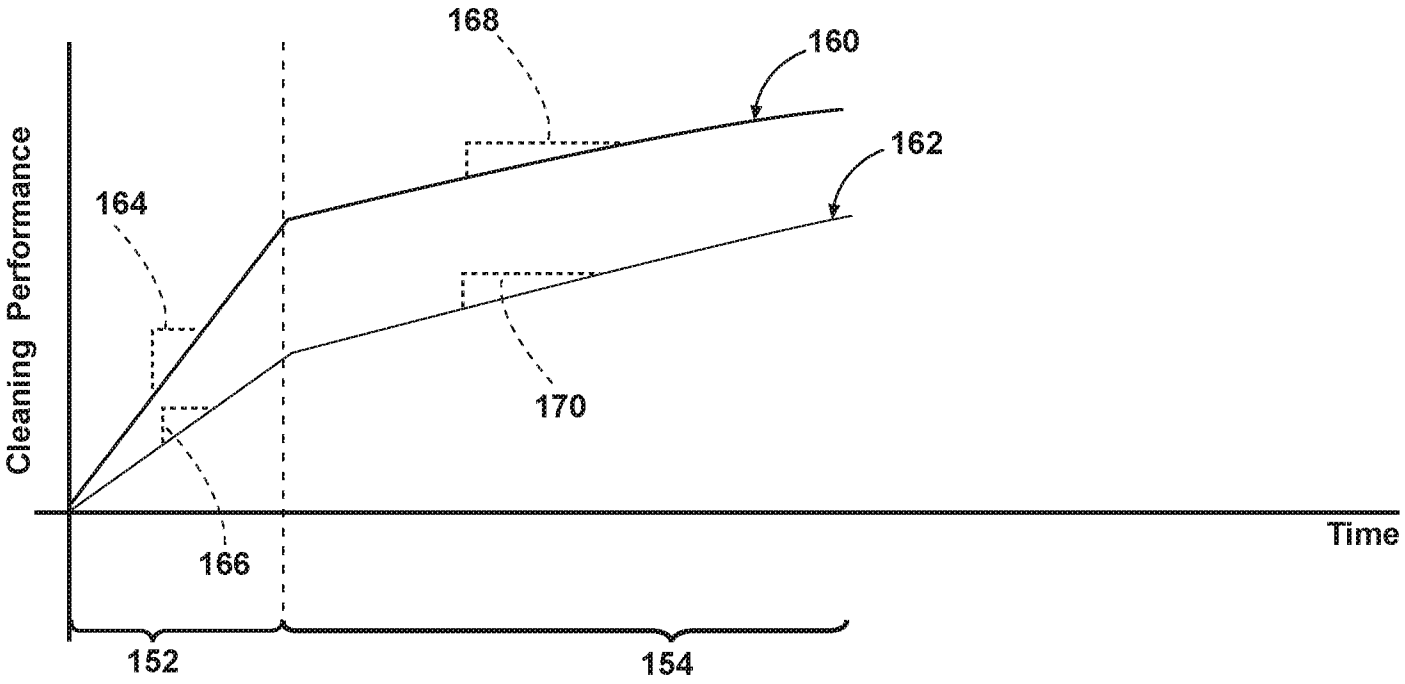
FIG. 6 is a plot illustrating the cleaning performance over time for a high duty cycle as compared to a low duty cycle.

Looking now at FIG. 6, various cleaning performances over time having a first duty cycle phase 152 and a second duty cycle phase 154 being representative of the high duty cycle phase 132 and the low duty cycle phase 134, respectively. A first plot 160 includes a high duty cycle during both the first duty cycle phase 152 and the second duty cycle phase 154. A second plot 162 includes a low duty cycle during both the first duty cycle phase 152 and the second duty cycle phase 154. During the first duty cycle phase 152, it can be appreciated that the cleaning performance is improved for the high duty cycle of the first plot 160 as compared to the low duty cycle of the second plot 162, with the high duty cycle 160 having a greater slope 164 and the low duty cycle 162 having a lesser slop 166. In as much, it is illustrated that during the first duty cycle phase 152, cleaning performance is improved utilizing the higher duty cycle.

During the second duty cycle phase 154, the high duty cycle 160 has a slope 168 similar to a slope 170 for the low duty cycle 162. During the second duty cycle phase 154, the overall cleaning performance difference between the high duty cycle 160 and the low duty cycle 162 does not change much. While the higher duty cycle may still technically provide better results, in that cleaning performance is technically improved, the difference in performance as between the high duty cycle 160 during the second phase 154 and the low duty cycle 162 during the second phase 154 becomes marginal or negligible. As can be seen from the similar slopes 168, 170 during the second phase, the differences in cleaning performance between operating at the high duty cycle 160 and the low duty cycle 162 are minimal or nominal.

It should be understood that the higher the duty cycle 160, the greater amount of energy is consumed by the washing machine 10. Therefore, it is preferential to optimize cleaning performance while minimizing the duty cycle rates in order to maximize efficiency of the washing machine 10. As can be appreciated from FIG. 5, optimal efficiency, by maximizing cleaning performance and minimizing motor usage, can be achieved by utilizing a high duty cycle 160 during a first duty cycle phase 152 and utilizing a low duty cycle 162 during a second duty cycle phase 154. The cleaning performance resulting from a high duty cycle 160 during the second duty cycle phase 154 is similar to that of a low duty cycle 162 suggesting that changes to duty cycle at that point in the cycle would not have significant impacts on cleaning performance. Therefore, it would be more efficient to utilize a low duty cycle 162 during the second duty cycle phase 154, when duty cycles have only a minimal impact on cleaning performance.

Furthermore, the high duty cycle phase can utilize at least one of a set of load characteristics or a set of operating characteristics to balance cleaning performance with energy efficiency. It will be understood that "a set" can include any number, including only one characteristic. More specifically, the amount of motor operation during the high duty cycle phase or the duration of the high duty cycle phase can be determined by the controller 70 as part of the cycle of operation. In this manner, parameters of the high duty cycle wash phase can be determined based on any number of load characteristic and operating characteristics.

Load characteristics can include but are not limited to: load mass, load volume, load weight, load color, fabric or load type. Operating characteristics, which can also be known as cycle characteristics, can include: wash liquid temperature, soil level, detergent type, detergent amount, mixed or residual detergent amounts, washing machine water level, fabric surface damage, wash time, cycle type, motor characteristics such as torque, current, power, signal frequency, phase change, speed, or otherwise, or anything that can be indicated via the user interface or sensor information such as an off balance condition, suds detection, turbidity, conductivity, concentration, hardness, or otherwise. This allows the washing machine 10 to adaptively determine the duration and amount of motor operation during the high duty cycle wash phase.

For example, with a high load weight, a higher duty cycle can improve wash performance and compensate for this load characteristic, which would normally contribute to a decreased wash performance. Similarly, with a low water temperature, a higher duty cycle can improve wash performance and compensate for this operating characteristic, which would normally decrease wash performance. The higher duty cycle can correlate to a longer duration duty cycle, a greater rate or amount of motor operation during the high duty cycle wash phase, or both. In this manner, the high duty cycle duration and amount of motor operation can be varied based on the load characteristics or operating characteristics to increase, decrease, maximize, or optimize cleaning performance and overall efficiency.

Figure 7:
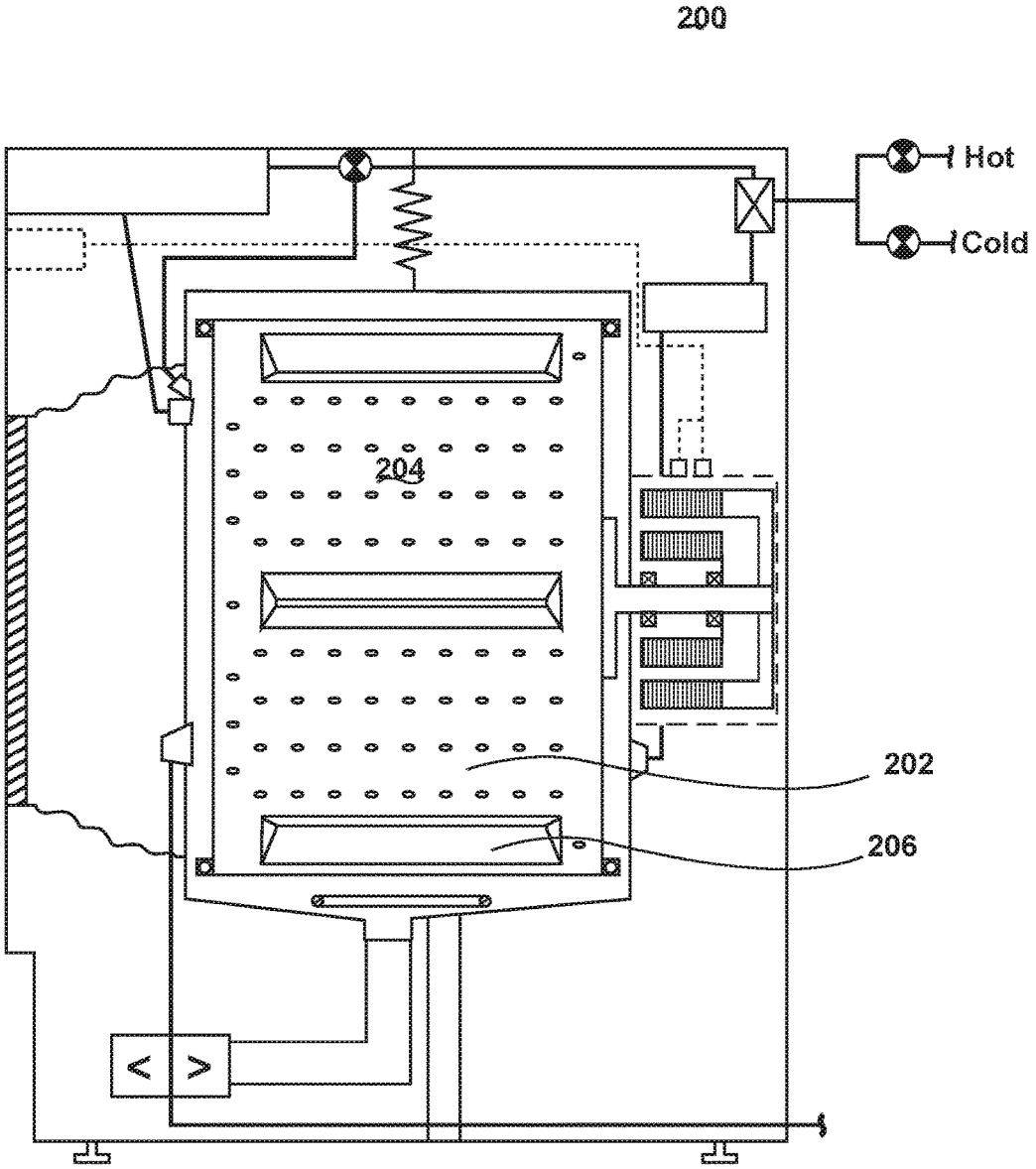
FIG. 7 is a schematic view of a laundry treating appliance in the form of a horizontal washing machine.

Referring now to FIG. 7, a horizontal axis clothes washer 200 is shown including a wash basket 202 defining a treating chamber 204 and a clothes mover 206 configured to rotate within the treating chamber 204.

It should be appreciated that as disclosed herein, a high duty cycle, including 75% or greater, is utilized during a first duty cycle phase during a cycle of operation and a low duty cycle, including 50% or less, is utilized during a second duty cycle phase. Conventional assumptions implement a high duty cycle during both the first and second duty cycle phases to maximize cleaning performance. However, the cleaning performance is similar regardless of applied high and low duty cycles during the second duty cycle phase, and efficiency is improved by utilizing a low duty cycle during the second duty cycle phase without sacrificing cleaning performance.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

It should be appreciated that the aforementioned method within a horizontal axis washing machine is exemplary, and use within alternative appliances are contemplated. The method can alternatively be utilized in additional laundry treating appliances such as a vertical axis washing machine, a combination washing machine and dryer, a tumbling refreshing/revitalizing machine, an extractor, and a non-aqueous washing apparatus, in non-limiting examples.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a horizontal axis clothes washer, comprising:

supplying wash liquid, comprising a mixture of detergent and water to a wash basket defining a treating chamber;

rotating a clothes mover within the treating chamber with an electric motor operating at a preliminary duty cycle of about 15% for the horizontal axis clothes washer to define a preliminary phase, and measuring at least one of a set of load characteristics or a set of operating characteristics during the preliminary phase;

after the preliminary phase, rotating the clothes mover within the treating chamber while the wash liquid is present with the electric motor operating at a first duty cycle greater than 75% for the horizontal axis clothes washer to define a high duty cycle wash phase and increasing the first duty cycle gradually and continuously during at least the first 20 minutes of the high duty cycle wash phase; and after the high duty cycle wash phase, rotating the clothes mover within the treating chamber while the wash liquid is present with the electric motor operating at a second duty cycle less than 50% for the horizontal axis clothes washer to define a low duty cycle wash phase; and wherein parameters of the high duty cycle wash phase are determined, by a controller, based on the at least one of the set of load characteristics or the set of operating characteristics measured during the preliminary phase.

2. The method of claim 1 wherein the first duty linearly increases to 100% during the high duty cycle wash phase.

3. The method of claim 1 wherein the rate of increase for the first duty cycle is constant.

4. The method of claim 1 wherein the rate of increase for the first duty cycle is variable.

5. The method of claim 1 wherein the first duty cycle increases to 100% during the high duty cycle wash phase.

6. The method of claim 1 wherein the first duty cycle increases to 90% during the high duty cycle wash phase.

7. The method of claim 1 wherein the first duty cycle is greater than 90% during the high duty cycle wash phase.

8. The method of claim 1 wherein the high duty cycle wash phase extends for a first predetermined time and the low duty cycle wash phase extends for a second predetermined time.

9. The method of claim 8 wherein the second predetermined time is longer than the first predetermined time.

10. The method of claim 8 wherein the second predetermined time is shorter than the first predetermined time.

11. The method of claim 1 wherein the set of load characteristics or the set of operating characteristics is at least one of a load volume, a load weight, a load color, a load type, a fabric surface damage, a soil level, a detergent type, a detergent amount, a detergent concentration, a water level, a water volume, a wash time for a cycle of operation input at a user interface, a cycle type input at the user interface, a user interface input at the user interface, a wash liquid temperature, a torque, a current, a power, a signal frequency of the electric motor, a phase change of the electric motor, a speed, an off balance condition, a suds detection, a turbidity, a conductivity, a concentration, or a water hardness.

12. A method of operating a horizontal axis clothes washer, comprising:

supplying wash liquid, to a wash basket defining a treating chamber, during a preliminary phase wherein the wash basket is not rotated or wherein the wash basket is rotated with an electric motor operating at a variable duty cycle;

rotating the wash basket, while the wash liquid is present, with the electric motor operating at a first duty cycle for greater than 75% for the horizontal axis clothes washer to define a high duty cycle wash phase including increasing the first duty cycle gradually at a constant rate during at least the first 20 minutes of the high duty cycle wash phase as described by;

$$D=25/30t+75$$

where:

D represents the first duty cycle; and t represents a current time in minutes of the high duty cycle wash phase; and after the high duty cycle wash phase, rotating the wash basket, while the wash liquid is present, with the electric motor operating at a second duty cycle less than 50% for the horizontal axis clothes washer to define a low duty cycle wash phase.

13. A method of operating a horizontal axis clothes washer, comprising:

supplying wash liquid, to a wash basket defining a treating chamber, during a preliminary phase wherein the wash basket is not rotated or wherein the wash basket is rotated with an electric motor operating at a variable duty cycle to vary the duty cycle during the preliminary phase;

rotating the wash basket, while the wash liquid is present, with the electric motor operating at a first duty cycle greater than 75% for the horizontal axis clothes washer to define a high duty cycle wash phase including increasing the first duty cycle gradually at a constant rate during at least the first 20 minutes of the high duty cycle wash phase; and after the high duty cycle wash phase, rotating the wash basket, while the wash liquid is present, with the electric motor operating at a second duty cycle less than 50% for the horizontal axis clothes washer to define a low duty cycle wash phase.

14. The method of claim 13 wherein the first duty cycle is determined based on at least one of a load volume, a load weight, a load color, a load type, a fabric surface damage, a soil level, a detergent type, a detergent amount, a detergent concentration, a water level, a water volume, a wash time, a cycle type, a user interface input, a wash liquid temperature, a torque, a current, a power, a signal frequency, a phase change, a speed, off balance condition, a suds detection, a turbidity, a conductivity, a concentration, or a water hardness.

15. The method of claim 14, wherein the first duty cycle increases to 100%.

16. The method of claim 13 wherein the first duty cycle is greater than 90%.

17. The method of claim 13 wherein the first duty cycle increases to 100% during the high duty cycle wash phase.

18. The method of claim 13 wherein the first duty cycle increases to 90% during the high duty cycle wash phase.

19. The method of claim 13 wherein the high duty cycle wash phase extends for a first predetermined time and the low duty cycle wash phase extends for a second predetermined time.

20. The method of claim 19 wherein the second predetermined time is longer than the first predetermined time.

21. The method of claim 19 wherein the second predetermined time is shorter than the first predetermined time.

* * * * *